US007244076B2

(12) United States Patent
Whitson

(10) Patent No.: US 7,244,076 B2
(45) Date of Patent: Jul. 17, 2007

(54) METHOD FOR INSTALLING PAVING BLOCKS

(75) Inventor: Robert L. Whitson, West Bend, WI (US)

(73) Assignee: Bend Industries, Inc., West Bend, WI (US)

( * ) Notice: Subject to any disclaimer, the term of this patent is extended or adjusted under 35 U.S.C. 154(b) by 0 days.

(21) Appl. No.: 10/893,812

(22) Filed: Jul. 19, 2004

(65) Prior Publication Data

US 2006/0013653 A1 Jan. 19, 2006

(51) Int. Cl.
*E01C 5/04* (2006.01)
*E01C 5/06* (2006.01)

(52) U.S. Cl. ..... 404/73; 404/34; 404/35; 404/36; 404/37; 404/38

(58) Field of Classification Search ..... 404/17–38, 404/43, 40, 73; 52/262, 263, 342, 385, 403.1; 405/302.4, 302.7
See application file for complete search history.

(56) References Cited

U.S. PATENT DOCUMENTS 2,746,365 A * 5/1956 Darneille ..... 404/2
4,146,599 A * 3/1979 Lanzetta ..... 264/35
4,445,802 A * 5/1984 Loov ..... 404/40
5,073,061 A * 12/1991 Jones ..... 404/7
5,102,260 A * 4/1992 Horvath et al. ..... 405/50
5,342,141 A * 8/1994 Close ..... 404/28
5,363,614 A * 11/1994 Faulkner ..... 52/263
5,531,044 A * 7/1996 Wallenius ..... 47/33
5,640,801 A * 6/1997 Rynberk ..... 47/33
5,957,619 A * 9/1999 Kinoshita et al. ..... 404/31
6,033,146 A * 3/2000 Shaw et al. ..... 404/20
6,796,096 B1 * 9/2004 Heath ..... 52/403.1
2001/0048849 A1 * 12/2001 Rinninger ..... 404/41
2003/0020057 A1 * 1/2003 Sciandra ..... 256/24
2006/0032170 A1 * 2/2006 Vershum et al. ..... 52/403.1

FOREIGN PATENT DOCUMENTS

FR 2762635 A1 * 10/1998

OTHER PUBLICATIONS

CPI Tek, Concrete Paver Institute, CPI TEK 2 Brochure, 1990, 4 pages.
CPI Tek, Concrete Paver Institute, CPI TEK 3 Brochure, 1993, 4 pages.
"Do-It-Yourself Paths and Patios", "A Step by Step Guide to Installing Ultralock 9000 Interlocking Pavers", The Family Handyman, brochure by Bend Industries, 1992, 12 pages.

* cited by examiner

*Primary Examiner*—Raymond W. Addie
(74) *Attorney, Agent, or Firm*—Ryan Kromholz & Manion, S.C.

(57) ABSTRACT

A method of installing paving blocks comprises preparing an area to be paved to a desired grade. A preformed, load-bearing sheet of material, e.g., extruded polystyrene, is placed on the prepared area. Paving blocks are then laid in a desired pattern on the sheet of material.

1 Claim, 11 Drawing Sheets

METHOD FOR INSTALLING PAVING BLOCKS

FIELD OF INVENTION

This invention relates to installing dry-laid masonry paving blocks, e.g., pavers, to create a path, driveway, or patio.

BACKGROUND OF THE INVENTION

The use of concrete paving blocks ("pavers") in landscaping is common. Pavers are widely used for driveways, sidewalks, patios, garden paths, and even porch floors. Individually, they are lightweight and durable. Pavers withstand abuse by flexing, rather than cracking, under pressure. They're ideal for regions that go through freeze/thaw cycles, as individual pavers absorb heaving and movement without cracking. Pavers also provide for easy repair, as replacing an individual paver or small area of pavers is easier and less costly than replacing a large concrete slab.

Conventional methods of installing masonry paving blocks ("pavers") require the installer to outline the perimeter of the area being paved. Sod and/or soil are then removed to excavate the area. The desired grade is established and the area can be staked as necessary to ensure the proper elevation of the paved surface. A subbase, e.g., Class 5 crushed limestone, is placed over the excavated area. The subbase is desirably then tamped (e.g., with a vibrator) to tightly compact the subbase. Edging is installed at the perimeter of the area to be paved. The edging provides lateral (horizontal) resistance to the pavement, thereby maintaining the interlock and load spreading capabilities of the units. A variety of different types of edging are commonly used, including wood, steel, aluminum, PVC, and concrete. Sand is then spread over the subbase and leveled by screeding to form a sand base or layer. The pavers can then be laid in a desired pattern and tamped with a vibrator to lock the pavers into the sand and help even the surface. Additional sand is then spread over the pavers and swept or otherwise driven into the joints between the pavers to lock the pavers together and fill voids. A water sealer can be applied over the completed paved area if desired.

It is apparent that these methods can require some technical knowledge or expertise and are generally tedious and time-consuming. Consequently, a professional often performs the installation. In many cases, however, the homeowner or landowner desires to perform the installation as a "do-it-yourself" project. This not only eliminates the cost of hiring a professional, thereby significantly reducing the total cost of the project, but also provides a sense of satisfaction and accomplishment to the homeowner or landowner.

Therefore, there is a need to simplify methods of installing pavers to permit installation by non-professionals with limited or no technical knowledge. The need also remains for simplified systems and methods of installing pavers that are both cost and time-efficient to both professional and non-professional installers without sacrificing the structural integrity of the installation.

SUMMARY OF THE INVENTION

According to one aspect of the invention, a method of installing paving blocks comprises preparing an area to be paved to a desired grade, placing a preformed, load-bearing sheet of material on the prepared area, and laying paving blocks in a desired pattern on the sheet of material. In one embodiment, the preformed, load-bearing sheet of material is a foam sheet. The foam sheet may have a grid marked thereon. In one embodiment, the foam sheet is extruded polystyrene.

According to another aspect of the invention, the area to be paved is outlined prior to preparing the area.

According to another aspect of the invention, the area to be paved is staked and the desired grade elevations are marked prior to preparing the area.

According to another aspect of the invention, a joint-filling material is placed in spaces between the paving blocks. In one embodiment, the joint-filling material is sand. The sand may be a polymeric or stabilized sand requiring activation to harden the sand. According to another aspect of the invention, liquid is sprayed over the blocks to soak and thereby activate the sand. In one embodiment, the liquid is water.

According to another aspect of the invention, an edging material is laid after placing the load-bearing sheet to restrain lateral (horizontal) movement of the pavers. A soldier course of paving blocks is then placed on top of the sheet. In an alternative embodiment, an adhesive is placed between a plurality of the paving blocks comprising the soldier course to restrain lateral (horizontal) movement of the pavers, eliminating the need for an edging material. In one embodiment, the adhesive is a masonry adhesive.

DESCRIPTION OF THE PREFERRED EMBODIMENT

Although the disclosure hereof is detailed and exact to enable those skilled in the art to practice the invention, the physical embodiments herein disclosed merely exemplify the invention that may be embodied in other specific structure. While the preferred embodiment has been described, the details may be changed without departing from the invention, which is defined by the claims.

A method of installing paving blocks ("pavers") will be described with reference to the figures, in which like reference numbers denote like parts. In the illustrated embodiment, the pavers take the form of interlocking paving stones. However, it is contemplated that a variety of different types and sizes of pavers may be used, e.g., concrete or natural stone patio shapes in square, rectangle, rhombus or other geometric shapes of generally uniform thickness and dry set with close joints.

Figure 1:
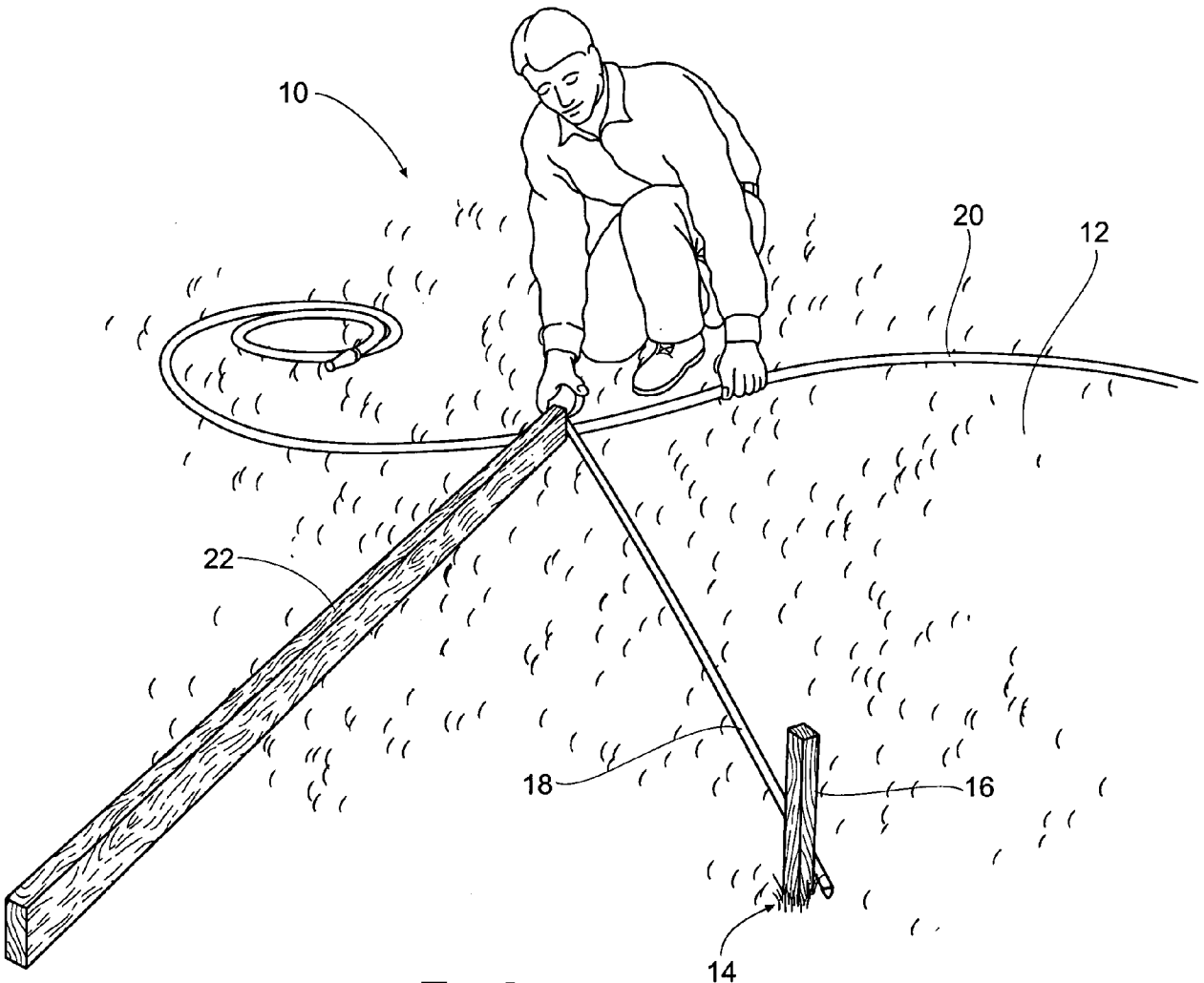
FIG. 1 is a perspective view of the marking of an area to be paved.

As illustrated in FIG. 1, an area of ground 10 is outlined to define the area 12 to be paved. To assist in outlining the area the area 12 to be paved, the center point 14 of the area 12 to be paved can be marked to serve as a reference point, e.g., with a post 16. The area 12 to be paved is then measured, e.g., with a tape measure 18 or other suitable measuring device. Curved areas may be marked with a hose 20 or other suitable flexible device. Straight areas may be marked with a board 22 (e.g., 2 in.×4 in.) or other suitable device. The ground 10 is marked until the perimeter of the area 12 to be paved is outlined in its entirety.

Desirably, the outline of the area 12 to be paved is then marked, e.g., with spray-paint, to act as a guide for excavating (not shown). It may be desirable to make an outline that is slightly larger than the area 12 to be paved, e.g., 8 in. from the perimeter of the area 12 to be paved, to provide an enlarged working area. The enlarged working area prevents grass from getting in the way of any guide strings or other markers that will be set up.

Figure 2:
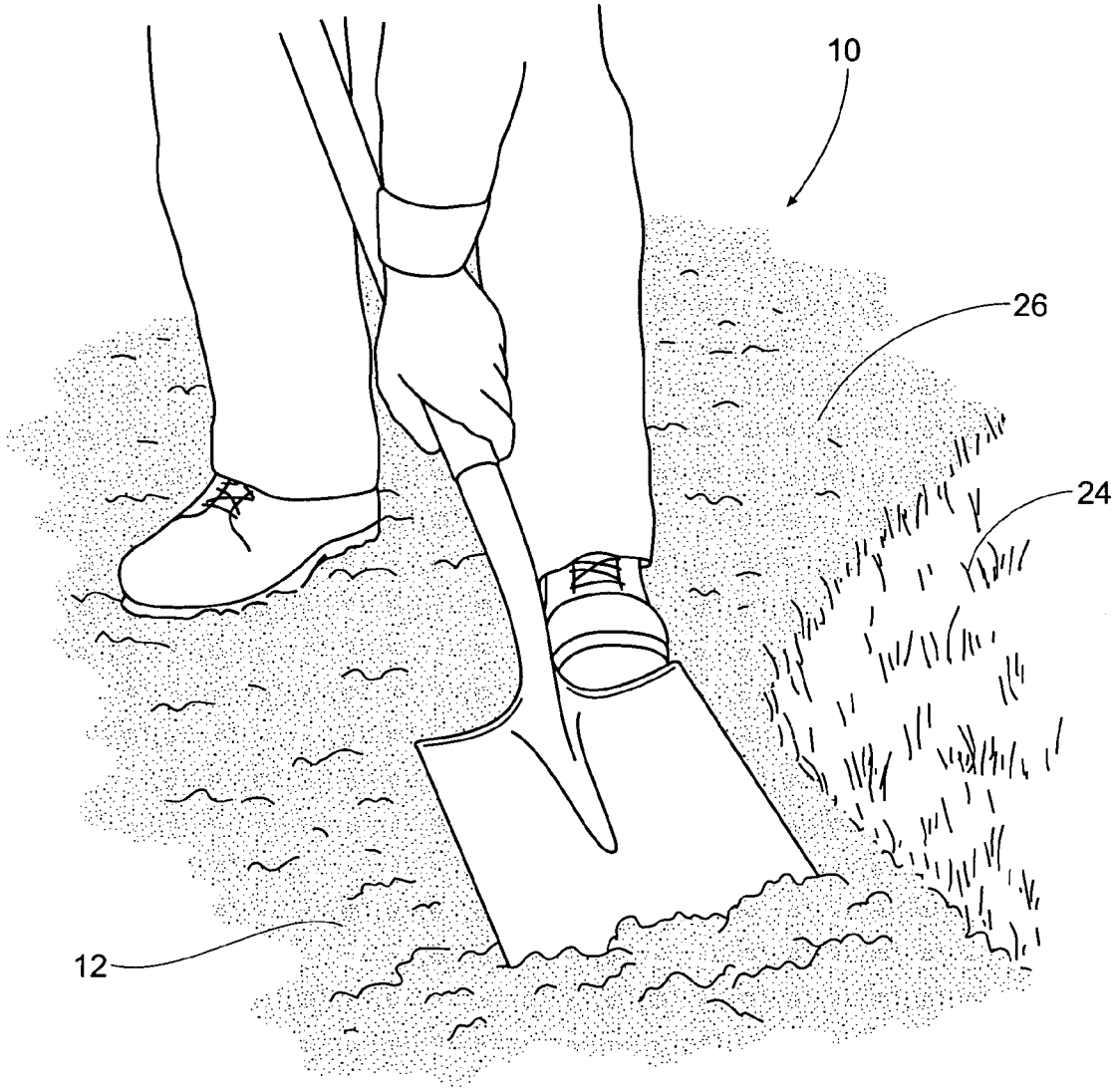
FIG. 2 is a perspective view illustrating the excavation of soil from the area to be paved.
Figure 3:
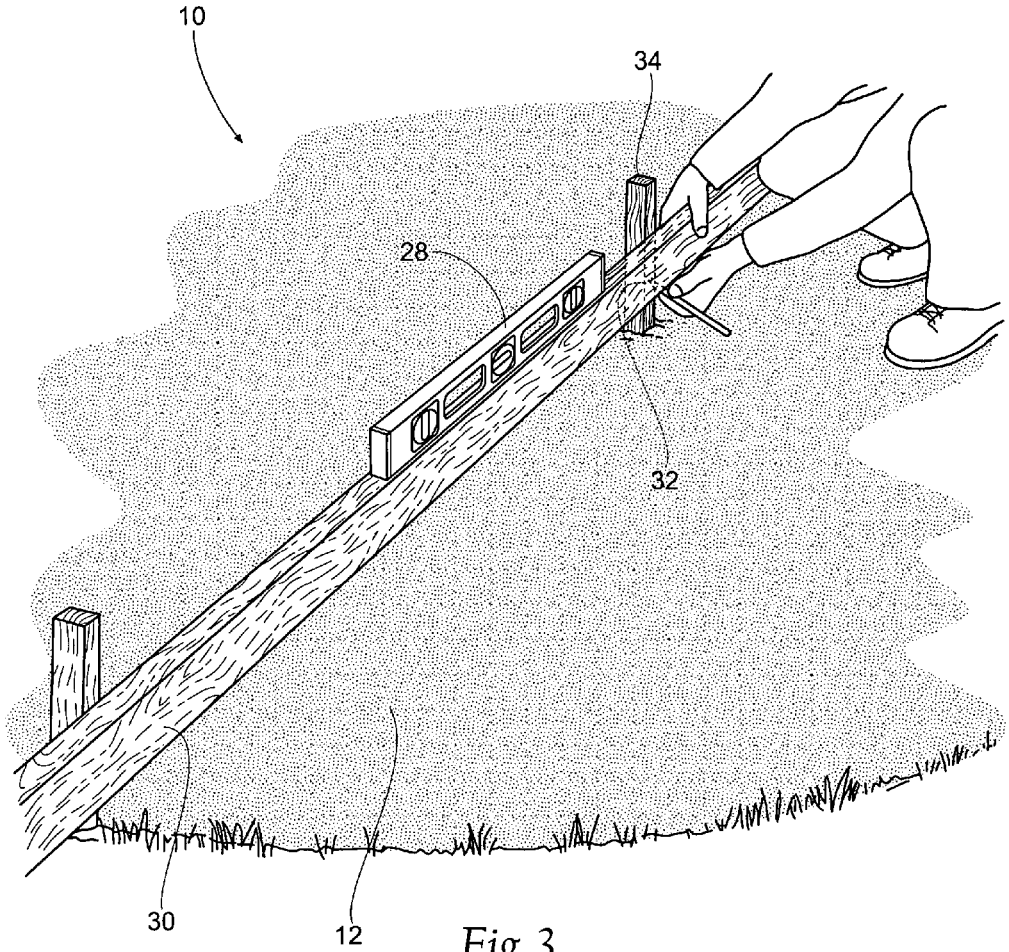
FIG. 3 is a perspective view illustrating the marking of a desired grade for an area to be paved.
Figure 4:
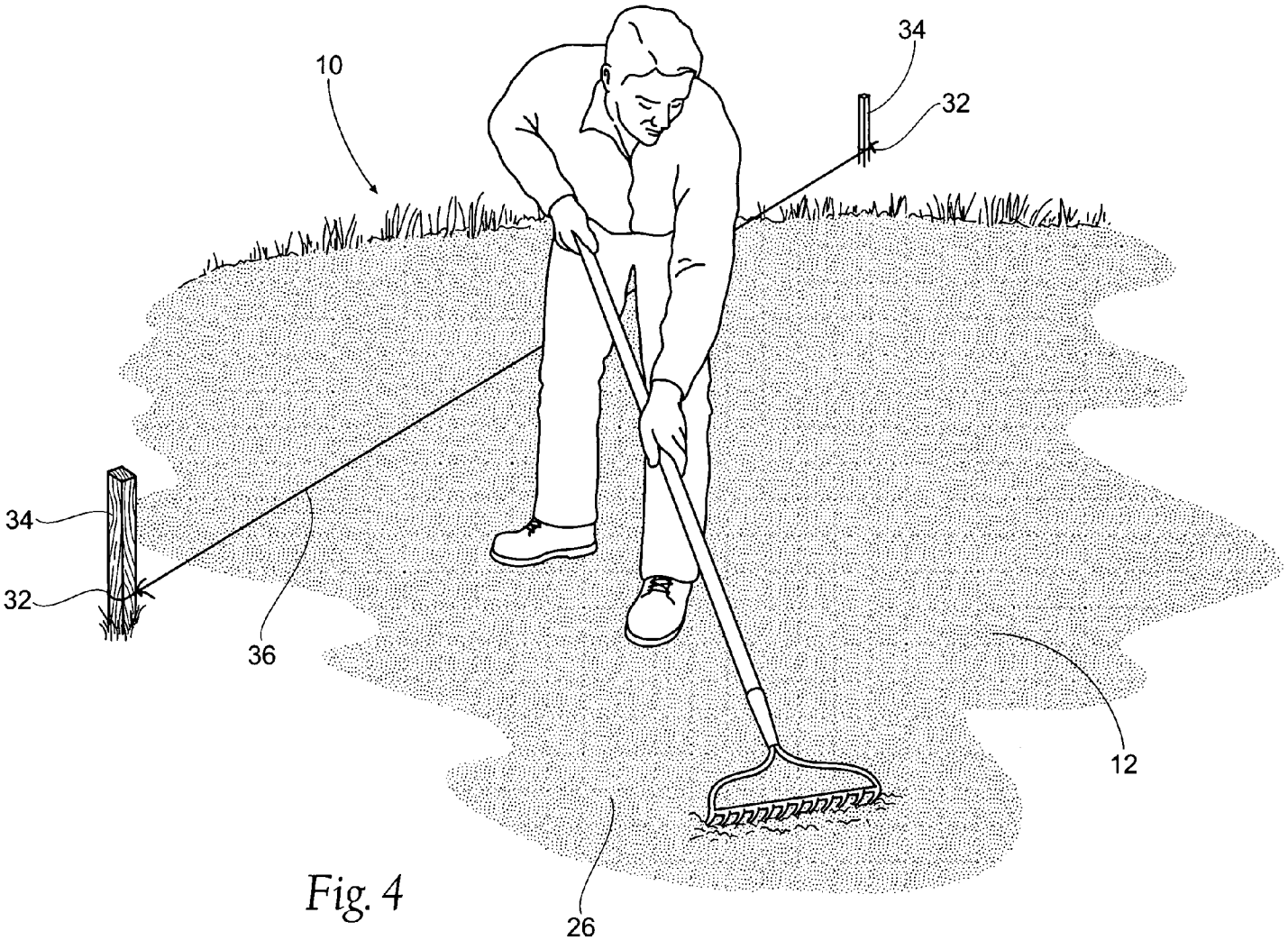
FIG. 4 is a perspective view illustrating the smoothing and leveling of the soil along a marked grade to prepare the area to be paved.

As FIG. 2 shows, sod 24 and/or soil 26 are removed to prepare the area 12 to be paved. With reference now to FIGS. 3 and 4, the installer can then stake the area and establish grade elevations to ensure the proper elevation of the paved surface. It is usually desirable that the paved surface has a slight slope (e.g., 1 in. for every 4 to 8 ft.) for proper drainage. For example, as seen in FIG. 3, a level 28 and a 2 in.×4 in. or other suitable board 30 may be used to mark the grade by placing a mark 32 on posts 34 in the ground 10. Once the grade is marked, string or rope 36 can be extended between the marks 32 to indicate the grade, as shown in FIG. 4.

Figure 5:
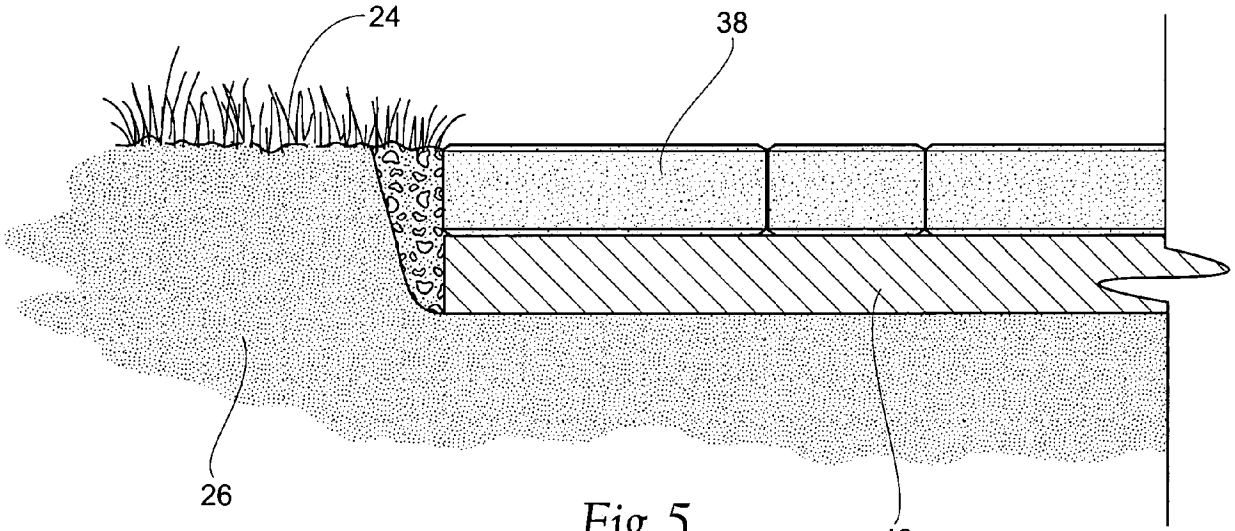
FIG. 5 is a side sectional view illustrating placement of a foam base and a series of paving blocks to establish a paved surface that is flush with the existing grade.
Figure 6:
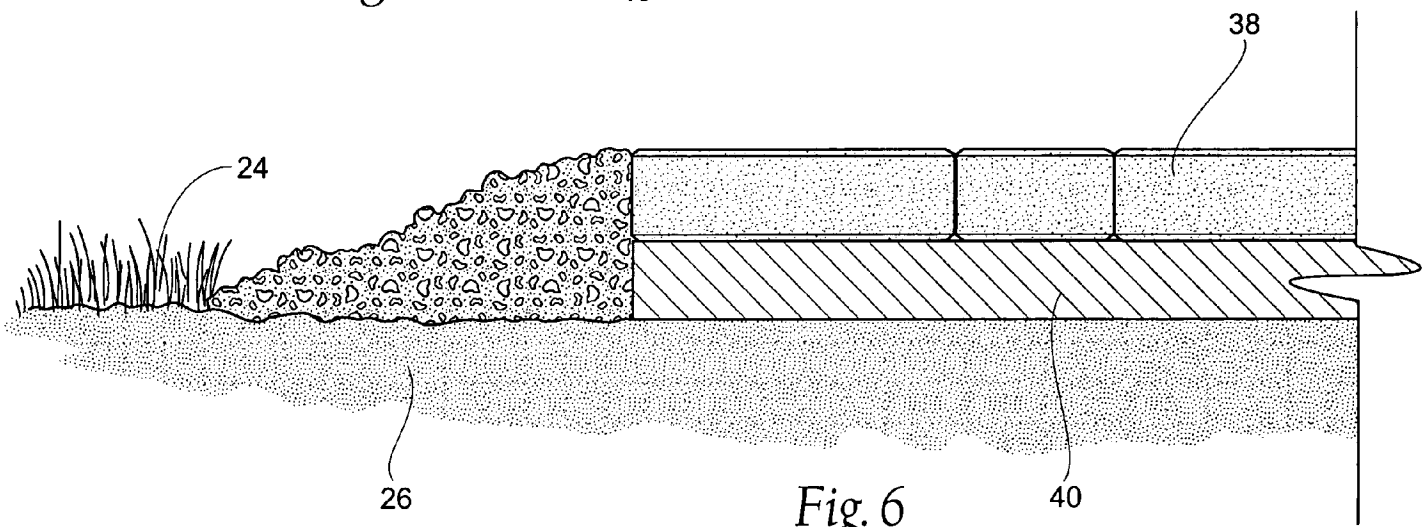
FIG. 6 is a side sectional view illustrating placement of a foam base and a series of paving blocks to establish a paved surface that is raised or elevated with respect to the existing grade.

Once the grade is marked, excavation may be completed. If it is desired that the paved surface when completed be flush with the existing grade, it is necessary for the installer to excavate to the proper depth. For example, and as FIG. 5 shows, to accommodate a standard 2-inch deep paver 38 on top of a two-inch base 40, it would be necessary to excavate the soil 26 to a depth of 4 inches. In the illustrated embodiment, the base 40 is a 2 inch deep foam sheet, as will be described in detail later. If it is desired that the paved surface be raised above the existing grade, the installer need only remove the sod 24 from the area, as seen in FIG. 6. With reference again to FIG. 4, the soil 26 is scraped flat so as to be generally level and smooth.

A preformed, load-bearing sheet of material 40 or series of sheets 40 are placed over the soil base to cover the area 12 to be paved. The sheet 40 can be formed of any suitable material with sufficient insulating and bearing strength capabilities and providing sufficient density for the intended use (i.e., patio, vehicular traffic, etc.). The sheet 40 is desirably formed of an insulating or board-type foam material that is inexpensive, easy to use, durable, and widely available, e.g., polyisocyanurate, extruded polystyrene, or other similar materials. In a preferred embodiment, the foam sheet 40 is made of extruded polystyrene, e.g., STYROFOAM® foam available from the Dow Chemical Company. The foam sheet 40 permits load transfer from the pavers 38 to and across the foam sheet 40. The foam sheet 40 also eliminates the need for a compacted subbase, resulting in both cost and time savings. The foam base 40 also resists growth of grass and incursion of insects between the pavers 38.

Figure 7:
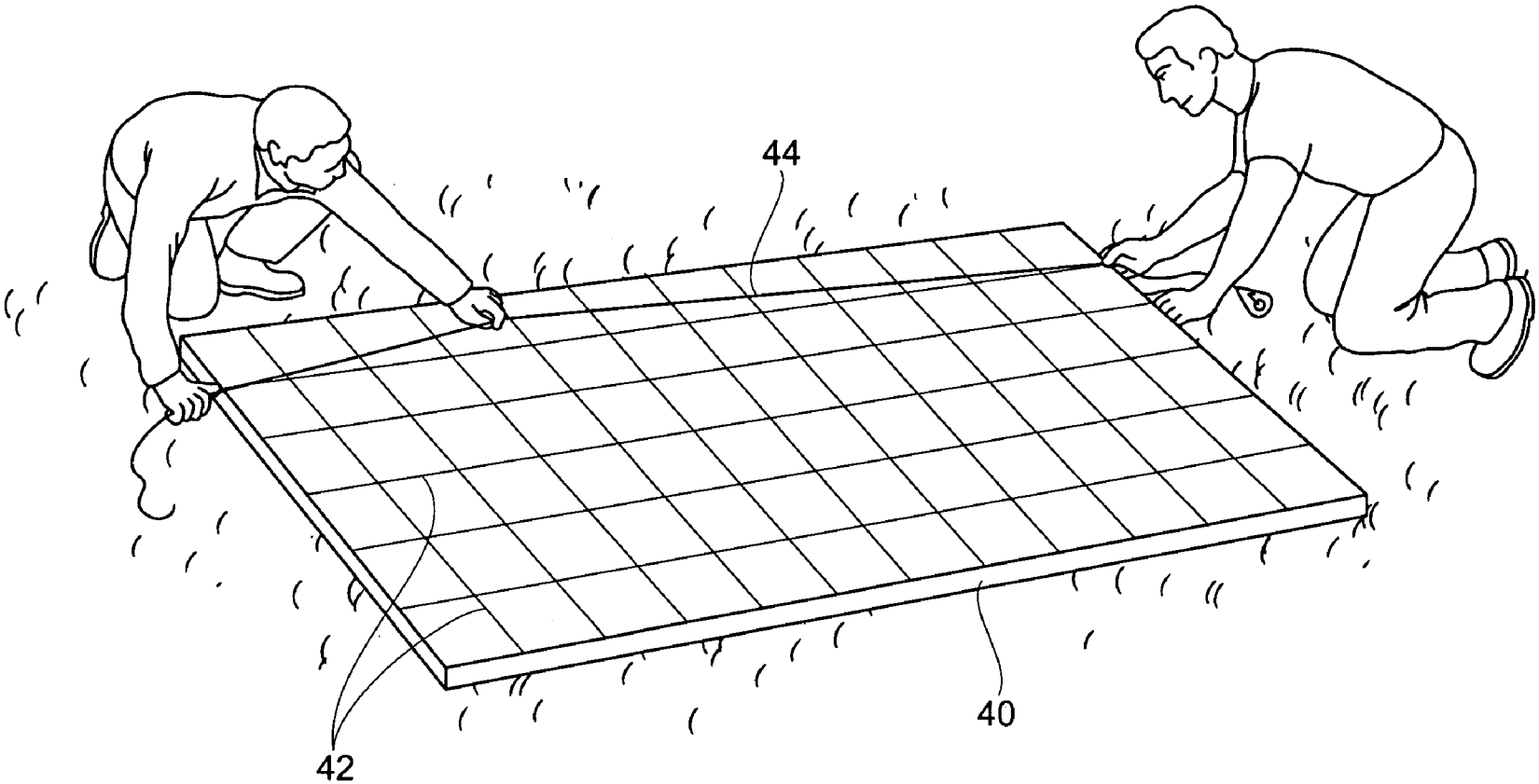
FIG. 7 is a perspective view illustrating the marking of a grid on a foam sheet base.

FIG. 7 illustrates the preparation of the foam sheet 40 by placement of a grid 42 marking on the sheet 40. The grid 42 serves as a guideline for proper placement of the pavers 38, allowing for quick placement of the pavers 38 and thus providing additional timesaving. For example, if standard 4 inch×8 inch pavers 38 are used, chalk lines may be snapped using a chalk line marker 44 in an 8 inch square grid pattern for the best paver 38 alignment and proper 1/16 inch joint gap between the pavers 38. The grid 42 is easily customized to accommodate any size or configuration of paver 38 as well as a specific design plan. The grid 42 may be preformed or pre-marked on the sheet 40 by the manufacturer or marked by the installer at the time of use to customize the grid 42.

Figure 8A:
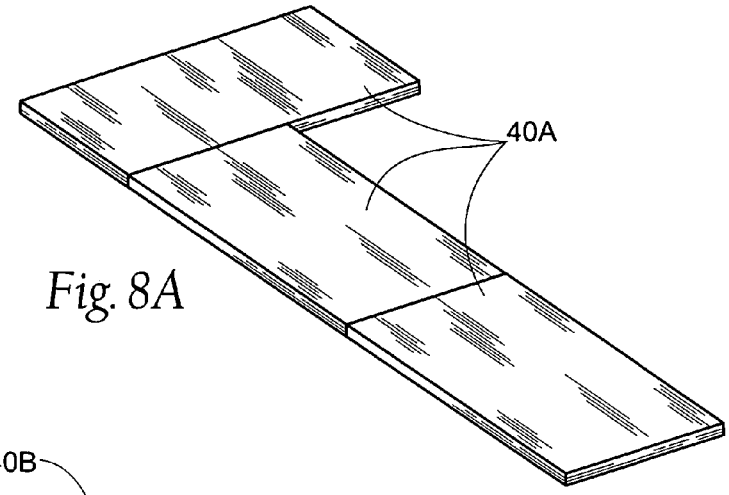
FIG. 8A is a perspective view illustrating the placement of a series of 4 ft.×8 ft. foam sheets to construct a pathway.
Figure 8B:
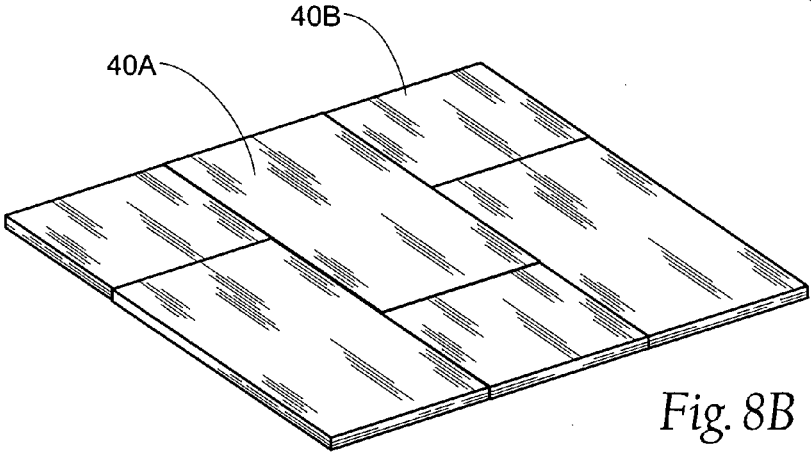
FIG. 8B is a perspective view illustrating the placement of a series of 4 ft.×4 ft. and 4 ft.×8 ft. foam sheets to construct a 12 ft.×12 ft. paved surface.
Figure 8C:
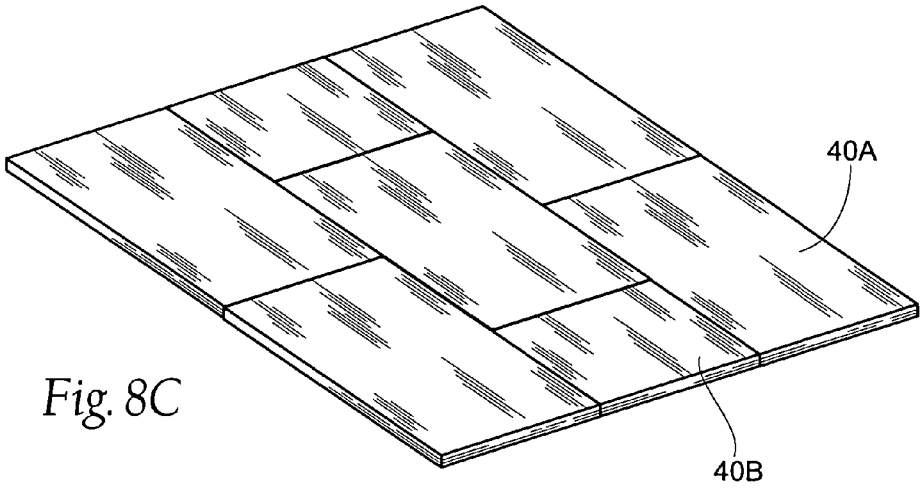
FIG. 8C is a perspective view illustrating the placement of a series of 4 ft.×4 ft. and 4 ft.×8 ft. foam sheets to construct a 12 ft.×16 ft. paved surface.

The foam sheet 40 is then laid on the prepared, undisturbed soil 26. In most cases, a series of foam sheets 40 will be required to fully cover and prepare the area 12 to be paved. It is contemplated that the sheets 40 may be laid in a variety of arrangements to accommodate specific design plans. The sheets 40 may also be cut or formed to a square, rectangular, or circular configuration or to any other desired configuration as necessary. For example, a series of 4 ft.×8 ft. sheets 40A may be arranged to construct a pathway (FIG. 8A), or a series of 4 ft.×8 ft. sheets 40A and 4 ft.×4 ft. sheets 40B may be arranged to construct a 12 ft.×12 ft. patio (FIG. 8B) or a 12 ft.×16 ft. patio (FIG. 8C). It is apparent that the configuration and placement of sheets 40 may be varied to accommodate virtually any design plan.

In a preferred embodiment, the foam sheets 40 have a thickness or depth of two inches. However, it is to be understood that sheets 40 having a greater or lesser depth can be used to accommodate specific needs.

To ensure long-term stability of the paved surface, it is necessary to restrain the pavers 38 around the perimeter edge of the paved surface. The perimeter restraint provides lateral (horizontal) resistance to movement of the pavers 38, thereby maintaining the interlock and load spreading capabilities of the paver units 38.

Figure 9:
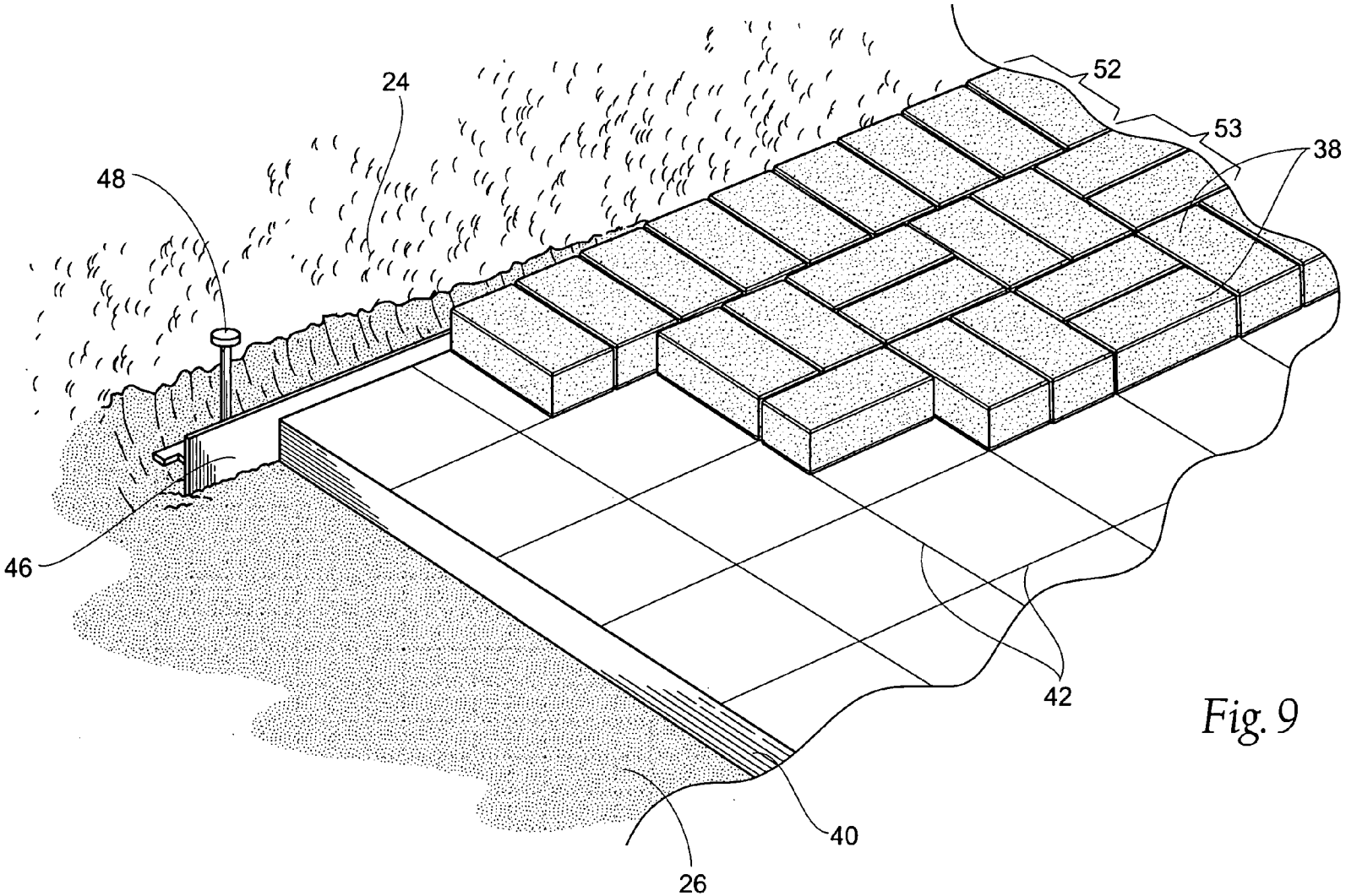
FIG. 9 is a perspective view illustrating the placement of a series of pavers on a foam sheet and illustrating the use of a mechanical edging barrier to restrain lateral (horizontal) movement of the pavers.

As shown in FIG. 9, perimeter restraint may be accomplished by the use of a mechanical barrier or edging 46, as is widely known in the art. Wood, steel, aluminum, PVC, and concrete are suitable materials for the edging 46, which may be secured by a pin 48 or other suitable securing means.

Figure 10:
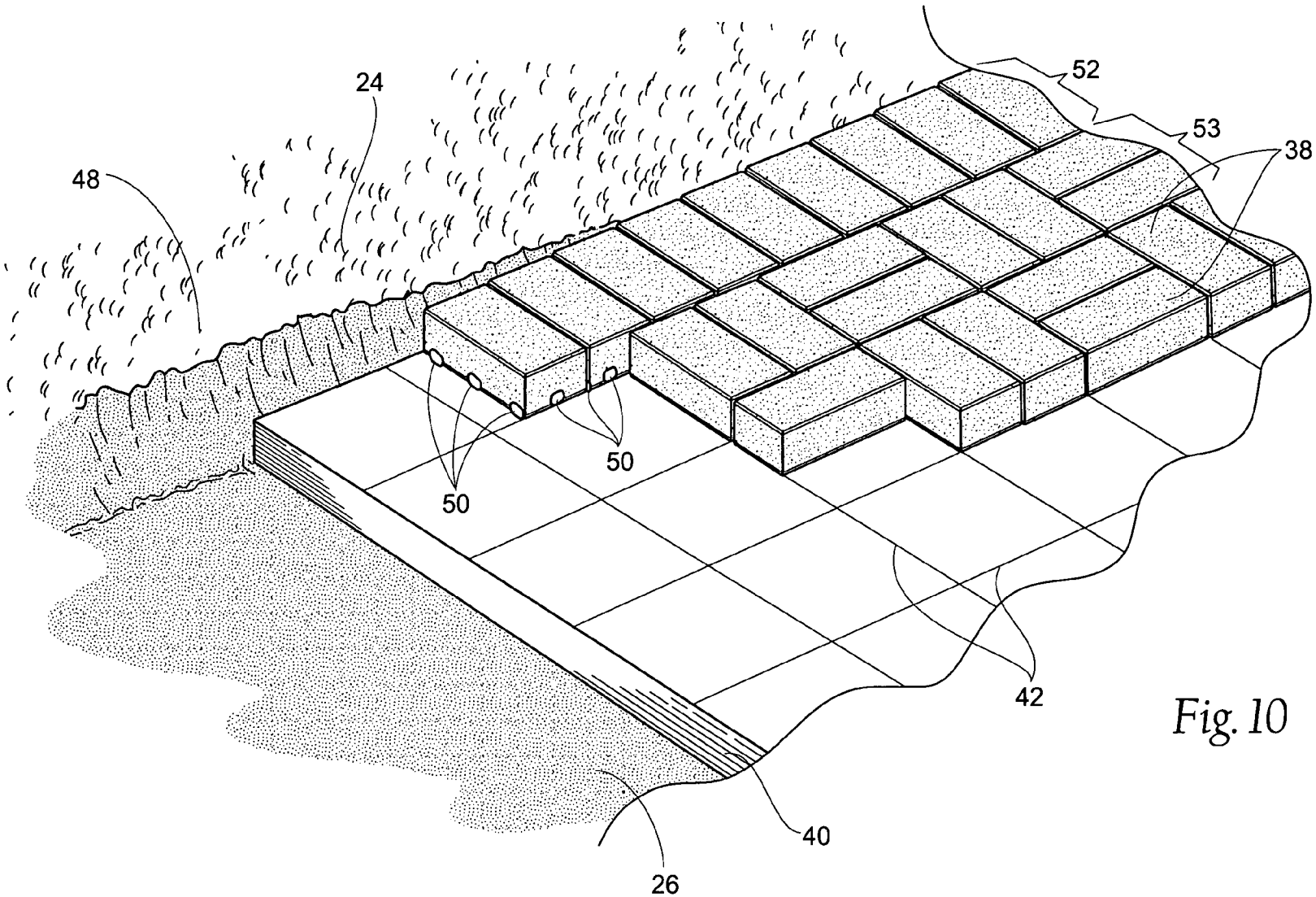
FIG. 10 is a view similar to FIG. 9 and illustrating the use of a masonry adhesive to restrain lateral (horizontal) movement of the pavers.

As FIG. 10 shows, perimeter restraint may alternatively be accomplished by the application of a masonry adhesive 50. The adhesive 50 may be applied between adjacent pavers 38 forming a perimeter or soldier course 52 to glue the soldier course pavers 38 side by side. If desired, the adhesive 50 may also be applied between pavers 38 forming the soldier course 52 and pavers 38 forming an adjacent interior course 53, as also shown in FIG. 10. Suitable adhesives 50 include PAVER BOND™ masonry adhesive available from Surebond, Inc. and TECHNI-SEAL® masonry adhesive available from Techni-Seal Chemicals, Inc. It is preferable that sufficient space or gaps be left between application points of the adhesive 50 so as to permit sand or other joint-filling material to be placed in the joints 56 between the pavers 38, as will be described in greater detail later.

The pavers 38 are laid on the foam sheet 40 in a desired pattern, as also shown in FIGS. 9 and 10. As previously noted, the foam sheet 40 permits load transfer of the pavers 38 to and across the foam sheet 40. The grid 42 may be used to assist in proper placement of pavers 38 in a wide variety of patterns, e.g., running bond, basket weave, or herring-bone. The grid 42 also permits the installer to begin installation with the soldier course 52 or with an inside course as desired to accommodate specific needs.

Figure 11:
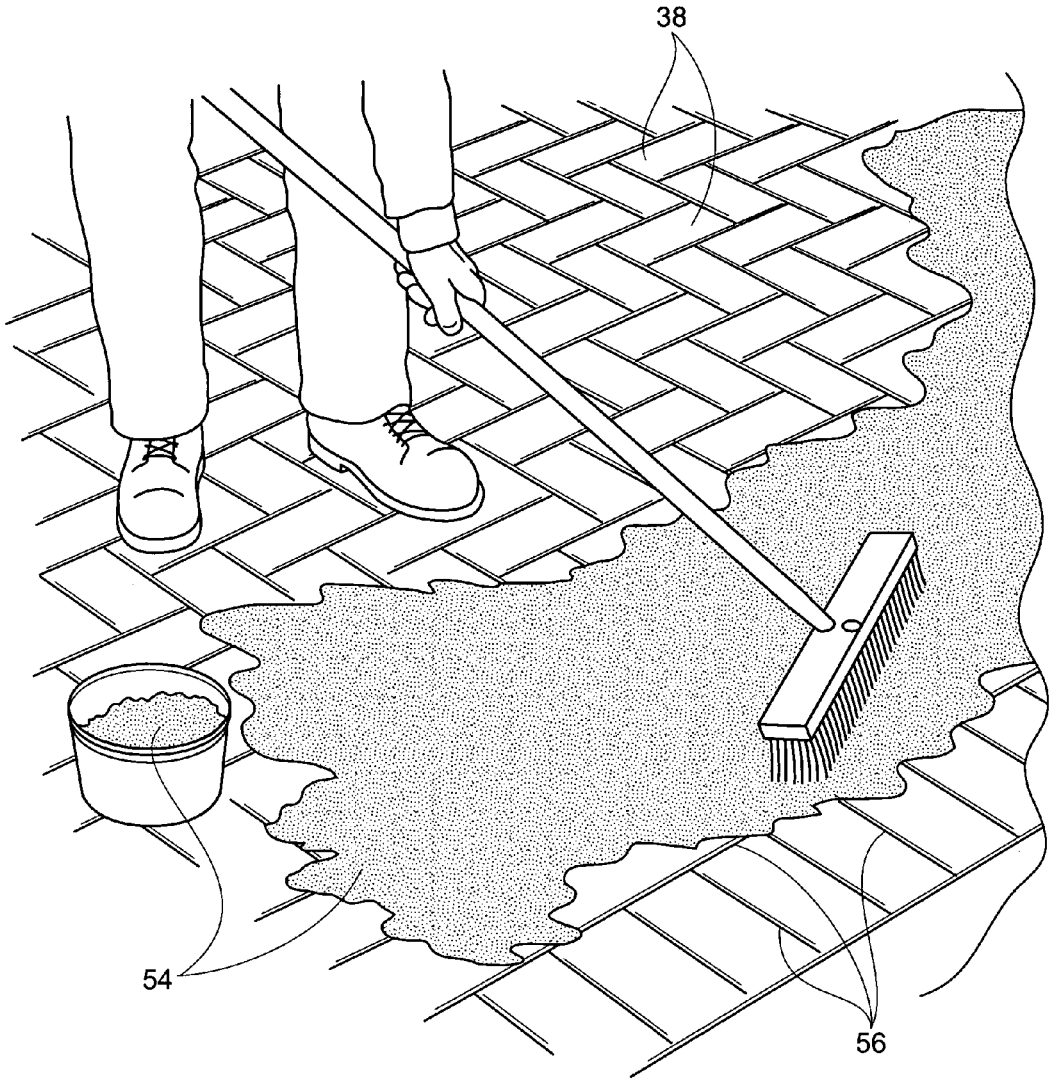
FIG. 11 is a perspective view illustrating the sweeping of stabilized or polymeric sand between the pavers to fill the joints between the pavers.
Figure 12:
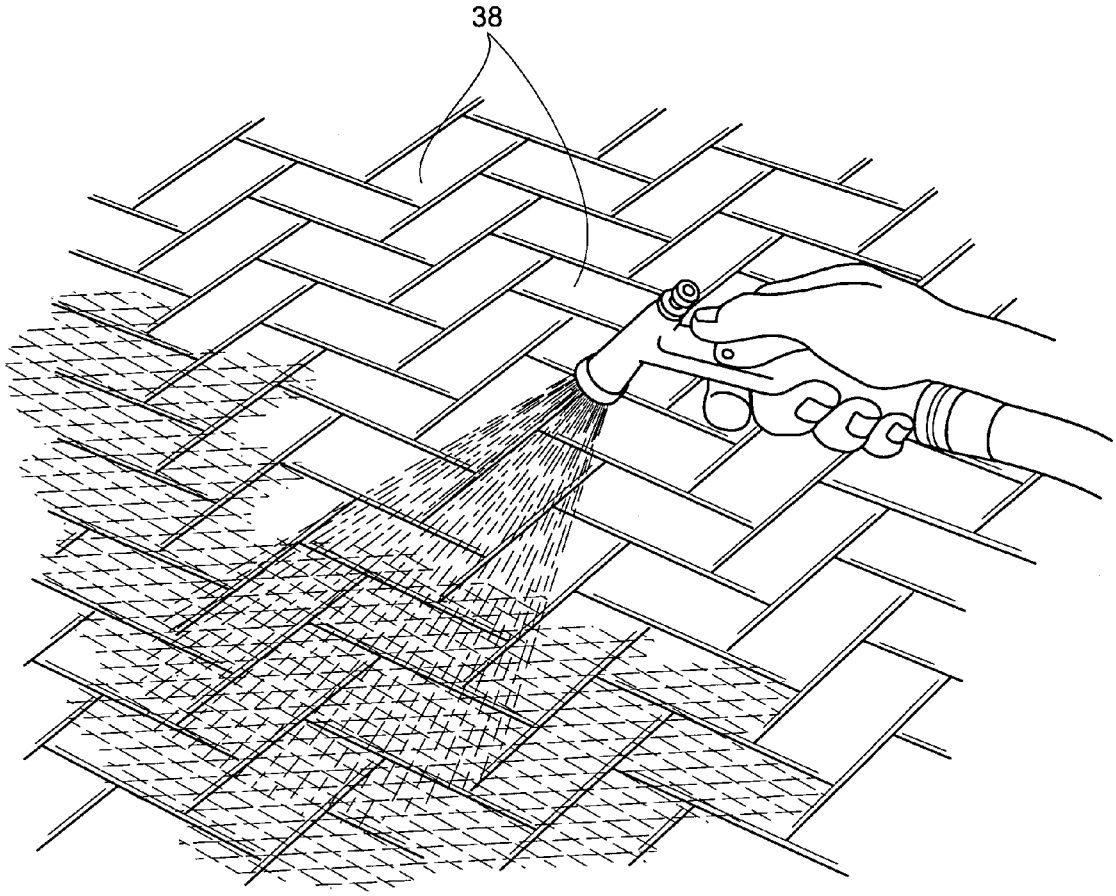
FIG. 12 is a perspective view illustrating the application of water to the paved surface to harden the sand.

After laying the pavers 38 in the desired pattern, the installer sweeps or otherwise places sand 54 into the joints 56 between the pavers 38, as FIG. 11 illustrates. The excess sand 54 is then removed. The sand 54 is preferably a stabilized sand, e.g., TECHNI-SEAL® polymeric sand available from Techni-Seal Chemicals, Inc. As seen in FIG. 12, the surface is then sprayed with water or other suitable liquid to soak the sand 54. The water activates the polymer, causing the sand 54 to harden. The hardened sand 54 provides long-term stability to the finished surface and resists incursion of insects between the pavers 38. The hardened sand 54 also serves to increase water runoff, further helping to maintain long-term stability.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. In a method of installing paving blocks comprising the steps of preparing an area to be paved to a desired grade;

the improvement comprising the steps of:

providing a sheet of preformed, load-bearing, board-type, foam material having sufficient load-bearing strength for supporting said paving blocks in addition to human and vehicular traffic traversing said paving blocks;

placing said preformed sheet of foam material directly upon the prepared area and without need of an underlying supporting substructure;

laying paving blocks in a desired pattern directly upon the preformed sheet of foamed material;

depositing a joint filling, water-activated, polymeric sand in spaces existing between said paving blocks, and thereafter water spraying the sand to provide long-term stability to the finished paved surface; and wherein the sheet of foam material includes a grid marked on its exposed surface, said grid being arranged for positioning of said paving blocks.

* * * * *